US011395782B2

(12) United States Patent
Qin et al.

(10) Patent No.: US 11,395,782 B2
(45) Date of Patent: Jul. 26, 2022

(54) INTELLIGENT MOBILITY ASSISTANCE DEVICE

(71) Applicant: Ping An Technology (Shenzhen) Co., Ltd., Shenzhen (CN)

(72) Inventors: Chaoping Qin, Cupertino, CA (US); Tian Xia, San Jose, CA (US); Mei Han, Palo Alto, CA (US); Peng Chang, Potomac, MD (US); Bo Gong, Belmont, CA (US)

(73) Assignee: Ping An Technology (Shenzhen) Co., Ltd., Shenzhen (CN)

( * ) Notice: Subject to any disclaimer, the term of this patent is extended or adjusted under 35 U.S.C. 154(b) by 199 days.

(21) Appl. No.: 16/729,184

(22) Filed: Dec. 27, 2019

(65) Prior Publication Data

US 2021/0196547 A1 Jul. 1, 2021

(51) Int. Cl.
*A61G 7/10* (2006.01)

(52) U.S. Cl.
CPC ..... *A61G 7/1048* (2013.01); *A61G 7/1019* (2013.01); *A61G 7/1059* (2013.01)

(58) Field of Classification Search
CPC .. A61G 7/1048; A61G 7/1019; A61G 7/1059; A61G 7/1046; A61G 7/1049; A61G 7/10; A61G 5/047
See application file for complete search history.

(56) References Cited

U.S. PATENT DOCUMENTS 2,339,007 A * 1/1944 Gahm ..... A61G 7/1061 297/5
5,380,034 A * 1/1995 Wilson ..... A61G 5/006 280/30
5,494,126 A * 2/1996 Meeker ..... A61G 5/047 180/13
6,095,271 A * 8/2000 Dickie ..... A61G 5/045 180/68.5
7,003,820 B1 * 2/2006 Iura ..... A61G 7/1092 5/83.1
7,306,250 B1 * 12/2007 Mills ..... A61G 5/047 180/11
7,686,324 B2 * 3/2010 Nishi ..... A61G 5/0816 297/340
2010/0287698 A1 * 11/2010 Stryker ..... A61G 7/1046 5/87.1
2011/0302712 A1 * 12/2011 Patterson ..... A61G 7/1076 5/88.1
2012/0080243 A1 * 4/2012 Mulhern ..... A61G 5/047 180/11

(Continued)

*Primary Examiner* — Peter M. Cuomo
*Assistant Examiner* — Alison N Labarge
(74) *Attorney, Agent, or Firm* — ScienBiziP, P.C.

(57) ABSTRACT

A device providing intelligent assistance in mobility for disabled people and others includes a mobility device and a lifting device detachably mounted on the mobility device. The lifting device includes a base frame, a retractable bracket structure, several wheels, a sitting pad, and a backrest. The wheels are mounted on a lower surface of the base frame and drive the lifting device to move. The retractable bracket structure is mounted on an upper surface of the base frame. The sitting pad is detachably mounted on the retractable bracket structure, and the backrest is rotatably mounted on the retractable bracket structure.

14 Claims, 11 Drawing Sheets

(56) References Cited

U.S. PATENT DOCUMENTS

| | | | | |
|---|---|---|---|---|
| 2013/0111660 | A1* | 5/2013 | Wilson | A61G 7/1019 5/86.1 |
| 2013/0264800 | A1* | 10/2013 | Kobayashi | A61G 5/0875 280/650 |
| 2018/0049934 | A1* | 2/2018 | Lucas | A61G 7/1046 |
| 2019/0008710 | A1* | 1/2019 | Wilson | A61G 7/1074 |
| 2019/0046373 | A1* | 2/2019 | Coulter | A61G 5/063 |
| 2019/0192374 | A1* | 6/2019 | Lass | A61G 5/1002 |
| 2020/0179201 | A1* | 6/2020 | Dancy | A47K 3/006 |

* cited by examiner

INTELLIGENT MOBILITY ASSISTANCE DEVICE

FIELD

The subject matter herein generally relates to a medical device field, and particularly, to an intelligent mobility assistance device.

BACKGROUND

For disabled and elderly people with limited physical strength, routine daily activities such as getting food, using a toilet, and taking a shower could be challenging. Many seniors who do not receive adequate assistance often get injured while performing these activities. In addition, a large number of those people are confined to bed or home because transferring into and driving a wheelchair become overwhelming tasks to achieve without the direct assistance from trained caregivers with enough physical strength. The aging population of east Asian countries such as Japan and China keeps increasing, means there is likely to be a shortage of trained caregivers. Therefore, a system to address the problem is disclosed.

BRIEF DESCRIPTION OF THE DRAWINGS

Implementations of the present disclosure will now be described, by way of example only, with reference to the attached figures.

DETAILED DESCRIPTION

Figure 1:
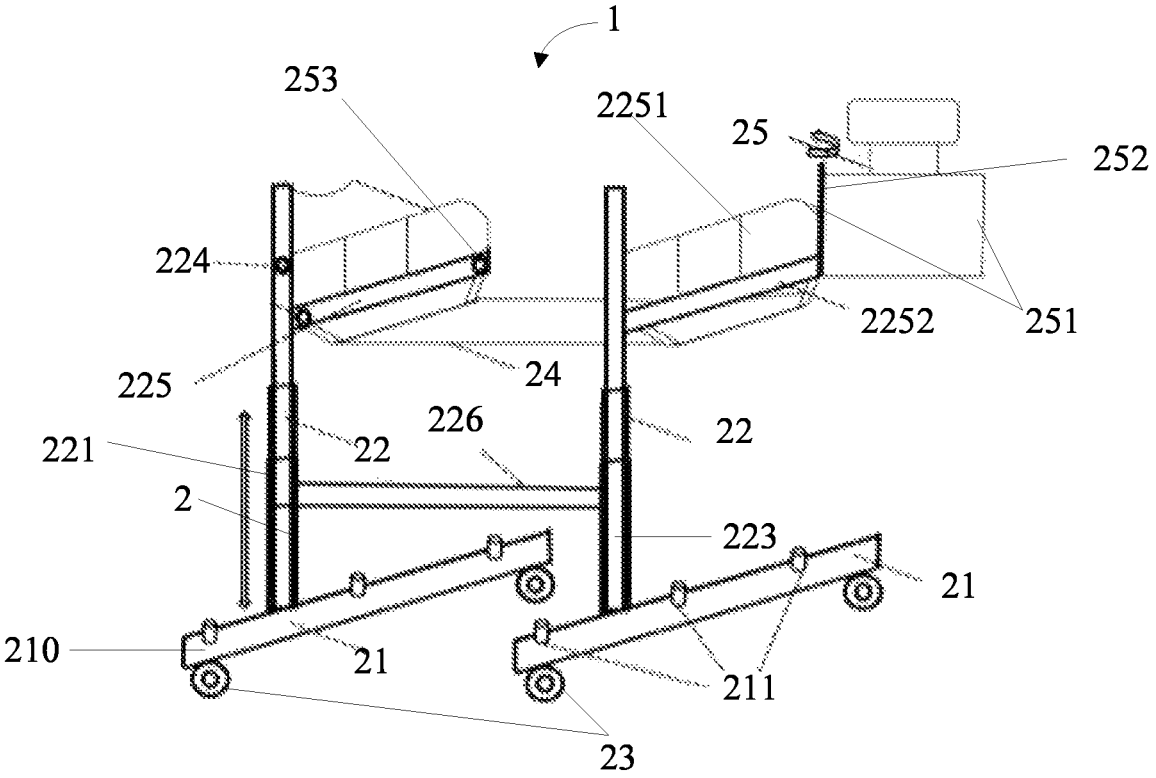
FIG. 1 is an isometric view showing an exemplary embodiment of an intelligent mobility assistance device.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the exemplary embodiments described herein.

The term "comprising" means "including, but not necessarily limited to"; it specifically indicates open-ended inclusion or membership in a so-described combination, group, series, and the like.

Exemplary embodiments of the present disclosure will be described in relation to the accompanying drawings.

FIG. 1 illustrates an exemplary embodiment of an intelligent mobility assistance device 1. The intelligent mobility assistance device 1 provides intelligent assistance to people with limited mobility. The intelligent mobility assistance device 1 includes a lifting device 2 and a mobility device 3. The lifting device 2 is detachably mounted on the mobility device 3. The mobility device 3 drives the lifting device 2 to move. In one embodiment, the lifting device 2 includes a base frame 21, a retractable bracket structure 22, a plurality of wheels 23, a sitting pad 24, and a backrest 25. The wheels 23 are mounted on a lower surface of the base frame 21 and is used to drive the lifting device 2 to move under the driving of the mobility device 3. The retractable bracket structure 22 is mounted on an upper surface of the base frame 21. The sitting pad 24 is detachably mounted on the retractable bracket structure 22. The backrest 25 is rotatably mounted on the retractable bracket structure 22, and a user can lean against the backrest 25. In one embodiment, when the backrest 25 is rotated and resting on the sitting pad 24, the user sitting on the sitting pad 24 can lean on the backrest 25.

In one embodiment, the retractable bracket structure 22 includes a support frame 221. The support frame 221 includes, but is not limited to, a first motor 222 (referring to FIG. 7), a vertical column 223, a retractable rod 224, and a mounting part 225. The first motor 222 is received in the base frame 21. The retractable rod 224 connects to the vertical column 223, and the first motor 222 drives the retractable rod 224 to stretch out from the vertical column 223 or retract into the vertical column 223. The mounting part 225 is fixed on the retractable rod 224. In one embodiment, the mounting part 225 is fixed on the retractable rod 224 by screws. The sitting pad 24 is detachably mounted on the mounting part 225. The backrest 25 is rotatably mounted on the mounting part 225.

In one embodiment, the base frame 21 is a pair of strips 210. In one embodiment, each of the strips 210 is made of metal or alloy material. In one embodiment, a pair of the wheels 23 is mounted on each of the pair of strips 210. For example, the pair of the wheels 23 is mounted on each of the pair of strips 210 near the ends of the strips 210. In another embodiment, many pairs of the wheels 23 can be mounted on many pairs of strips 210. In one embodiment, the retractable bracket structure 22 includes two support frames 221 and a horizontal rod 226. Each of the two support frames 221 is mounted on one of the pair of strips 210. The two support frames 221 connect to each other by the horizontal rod 226. In one embodiment, the horizontal rod 226 connects to two vertical columns 223 of the two support frames 221. In on embodiment, the mounting part 225 includes a safety rail 2251 and an arm part 2252. The safety rail 2251 is mounted on the retractable rod 224 of the support frame 221, and the support frame 221 can move upward or downward under the driving of the retractable rod 224. The sitting pad 24 is mounted on two arm parts 2252 of the two support frames 221. In one embodiment, the backrest 25 includes two ends 251. One of the two ends 251 of the backrest 25 is rotatably mounted on the safety rail 2251 of one of the two support frames 221 by a rotating shaft 252, another one of the two ends 251 of the backrest 25 connects to the safety rail 2251 of another one of the two support frames 221. For example, the backrest 25 can connect to the safety rail 2251 of the support frame 221 by a locking structure 253.

Figures 2A, 2B, 2C, 2D:
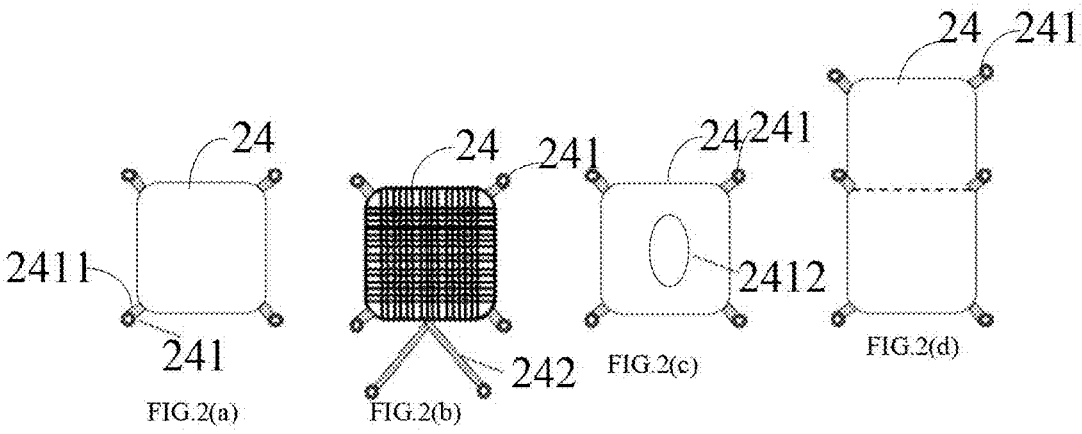
FIGS. 2(*a*), 2(*b*), 2(*c*), and 2(*d*) are isometric views showing an exemplary embodiment of a sitting pad of the device of FIG. 1.
Figure 3A:
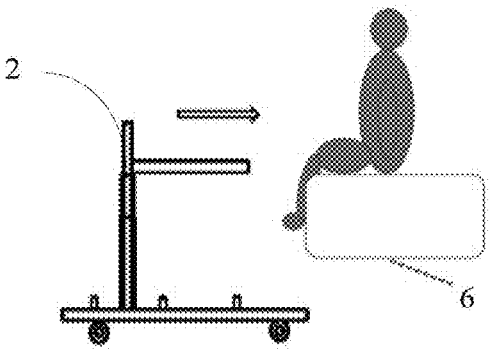
FIGS. 3(*a*), 3(*b*), 3(*c*), and 3(*d*) isometric views showing an exemplary embodiment of operations of a lifting device of the device of FIG. 1.
Figure 3B:
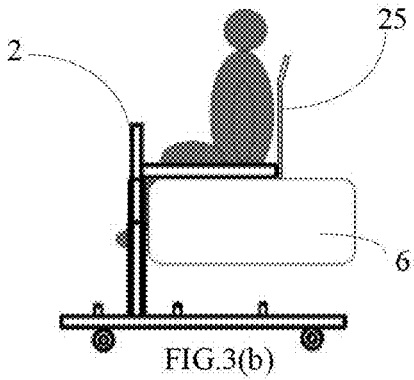
Figure 3D:
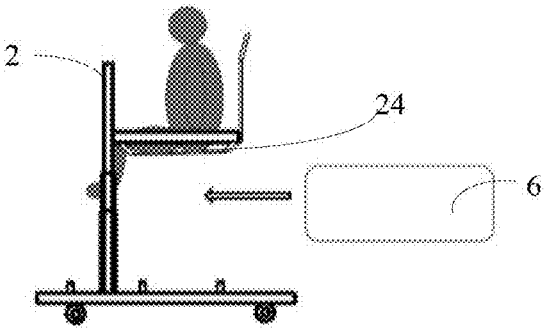
Figure 3C:
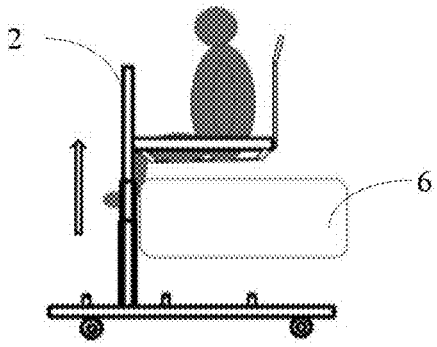

FIGS. 2(*a*)-2(*d*) illustrate an exemplary embodiment of the sitting pad 24. Referring to FIG. 2(*a*), the sitting pad 24 includes a connection part 241, and the sitting pad 24 connects to the arm part 2252 of the support frame 221 by the connection part 241. In one embodiment, the sitting pad 24 includes multiple connection parts 241, the connection parts 241 connect to top corners of the sitting pad 24. For example, the sitting pad 24 has four connection parts 241, the four connection parts 241 connect to four top corners of the rectangular sitting pad 24. In one embodiment, each connection part 241 includes a buckle 2411 and a hook (not shown). The buckle 2411 connects to the sitting pad 24 by a connection belt, and the hook is mounted on the arm part 2252 of the support frame 221. When the buckle 2411 connected to the sitting pad 24 is caught by the hook, the sitting pad 24 connects to the arm part 2252 of the support frame 221. When the buckle 2411 is separated from the hook, the sitting pad 24 is separated from the arm part 2252 of the support frame 221.

Referring to FIG. 2(*b*), the sitting pad 24 further includes two safety belts 242. The two safety belts 242 are mounted on one side of the sitting pad 24. The two safety belts 242 can connect to the arm part 2252 of the support frame 221 or can be separated from the arm part 2252. When the two safety belts 242 of the sitting pad 24 are connected to the arm part 2252 of the support frame 221, the sitting pad 24 is firmly mounted on the arm part 2252 of the support frame 221. In one embodiment, the sitting pad 24 can be made of rigid or soft materials for comfort and individual preference. In one embodiment, the sitting pad 24 can be a mesh-like pad made of waterproof materials, enabling to use in a shower. Referring to FIG. 2(*c*), in one embodiment, the sitting pad 24 has an opening 2412 in center of the sitting pad 24, enabling to use in the toilet. Referring to FIG. 2(*d*), in one embodiment, the sitting pad 24 has preset dimensions allowing a user to lie down.

FIGS. 3(*a*)-3(*d*) illustrate an exemplary embodiment of the lifting device 2 in use. A user puts a detached sitting pad 24 on a bed 6, a front side of the detached sitting pad 24 facing out from the bed 6, and the user moves to sit at the detached sitting pad 24 (referring to FIG. 3(*a*)). The lifting device 2 is controlled to move to a position of the detached sitting pad 24, and the detached sitting pad 24 is mounted on the two arm parts 2252 of the two supporting frame 221 (referring to FIG. 3(*b*)). Two retractable rods 224 of the two support frames 221 are driven to move upward by the first motor 222 to lift the user in the sitting pad 24 until the sitting pad 24 is clearly above the bed 6, the weight of the user can then be transferred to the lifting device 2 (referring to FIG. 3(*c*)). The lifting device 2 is moved away from the bed 6 by the mobility device 3, and the two arm parts 2252 can then be lowered for better stability and maneuverability by the first motor 222 (referring to FIG. 3(*d*)). Reversing the above sequence of steps, the user can be transferred from the lifting device 2 back to the bed 6 in the same safe manner.

Figure 4A:
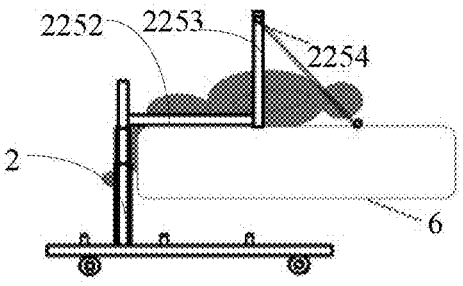
FIGS. 4(*a*), 4(*b*), and 4(*c*) are isometric views showing another exemplary embodiment of operations of the lifting device of FIG. 3.
Figure 4B:
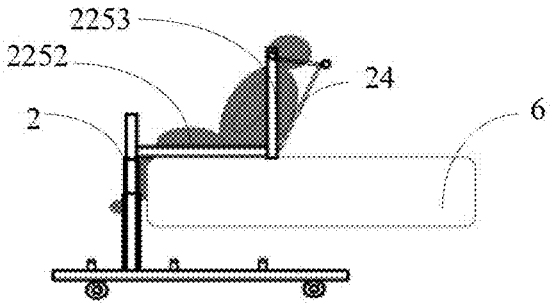
Figure 4C:
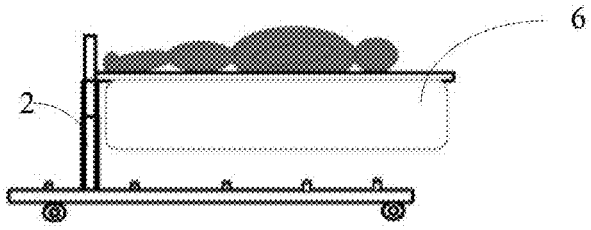

In one embodiment, the arm part 2252 includes an extra vertical column 2253. The extra vertical column 2253 extends vertically from the arm part 2252. FIGS. 4(*a*)-4(*c*) illustrate an exemplary embodiment of the lifting device 2. The sitting pad 24 is mounted on the arm part 2252 by the connection part 241, and the sitting pad 24 connects to a top end of the extra vertical column 2253 by a stretching part 2254. The stretching part 2254 can be pulled by a second motor received in the extra vertical column 2253. In one embodiment, the stretching part 2254 can be an elastic rope or a telescopic rod. With the help of the sitting pad 24 and the extra vertical column 2253, people can achieve a sitting pose. In one embodiment, the user puts a detached sitting pad 24 with the preset dimension on the bed 6, the front side of the detached sitting pad 24 facing out from the bed 6, and the user moves to lie on the detached sitting pad 24. The lifting device 2 is controlled to move to a position of the detached sitting pad 24, and the detached sitting pad 24 is mounted on the two arm parts 2252 of the two supporting frames 221 and the sitting pad 24 is connected to the top end of the extra vertical column 2253 by the stretching part 2254 (referring to FIG. 4(*a*)). The stretching part 2254 is pulled by the second motor to make the user sitting at the sitting pad 24 (referring to FIG. 4(*b*)). Reversing the above sequence of steps, the user can be transferred from the lifting device 2 back to the bed 6 (referring to FIG. 4(*c*)).

Figure 5A:
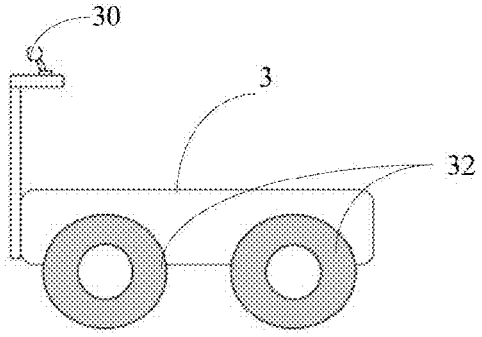
FIGS. 5(*a*), 5(*b*), and 5(*c*) are isometric views showing an exemplary embodiment of a mobility device of FIG. 1 in use.
Figure 5B:
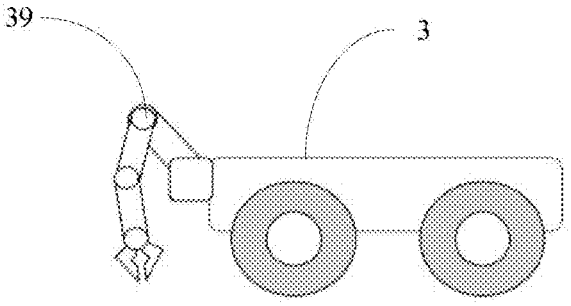
Figure 5C:
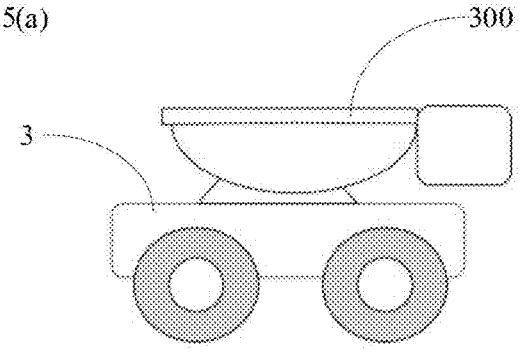
Figures 6A, 6B, 6C:
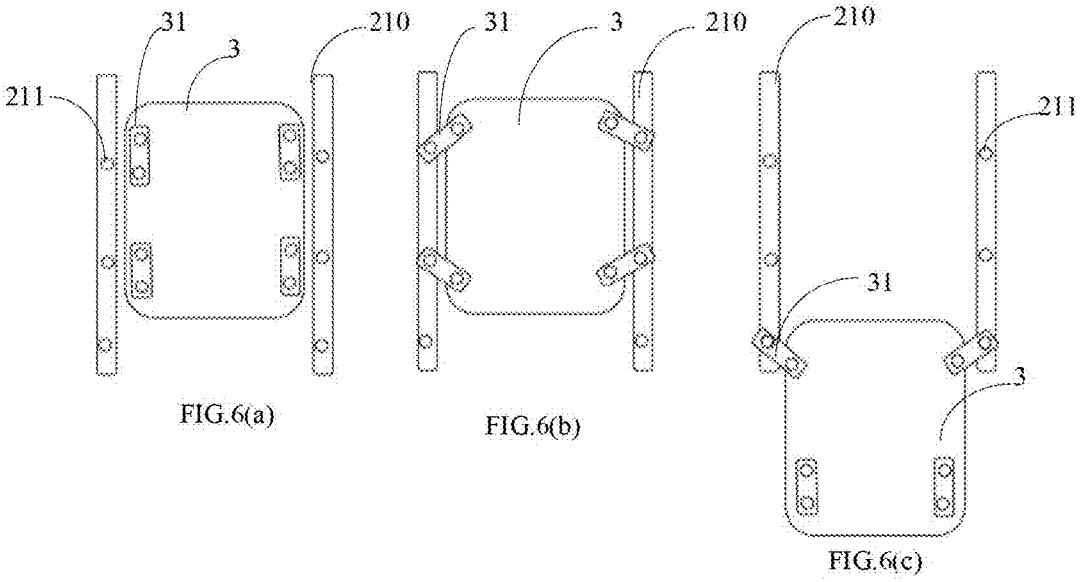
FIGS. 6(*a*), 6(*b*), and 6(*c*) are isometric views showing an exemplary embodiment of the mobility device connecting to the lifting device.

FIGS. 5(*a*)-5(*c*) illustrate an exemplary embodiment of the mobility device 3 in use. In one embodiment, the mobility device 3 is a mobile vehicle platform. FIGS. 6(*a*)-6(*c*) illustrate a diagram of the mobility device 3 connecting to the lifting device 2. In one embodiment, the mobility device 3 includes a plurality of connecting arms 31, a pair of second wheels 32, and a driving device 33. The driving device 33 drives the pair of second wheels 32 to rotate and steer the mobility device 3. In on embodiment, the pair of strips 210 defines the number of mounting parts 211. The number of connecting arms 31 of the mobility device 3 connects to the number of mounting parts 211 by a screwed structure, a snapfit structure, or a socketing structure to make the lifting device 2 connecting to the mobility device 3. In one embodiment, the connecting arm 31 can be a rotating rod. The rotating rod is rotated inward to be received in the mobility device 3, and outward to extend out of the mobility device 3. In one embodiment, when the rotating rod is rotated inward to be received in the mobility device 3, the mobility device 3 can move freely between the two pairs of strips 210 of the lifting device 2 under the driving of the driving device 33 (referring to FIG. 6(*a*)). In one embodiment, when the rotating rod is rotated outward to extend out of the mobility device 3 and mounted on the mounting parts 211 of the two pairs of strips 210, the mobility device 3 can be fixed under the sitting pad 24 (referring to FIG. 6(*b*)). Overall size of the intelligent mobility assistance device 1 is reduced, enabling the intelligent mobility assistance device 1 to move in a narrow space (e.g. an elevator or a bathroom). In one embodiment, when the rotating rod is mounted on an end of the mounting parts 211 (referring to FIG. 6(*a*)), an empty space by which the user can carry out some bathroom activities exists under the sitting pad 24.

In one embodiment, the screwed structure includes a screw, a first threaded hole, and a second threaded hole. In detail, the mounting part 211 defines the first threaded hole, and the connecting arm 31 of the mobility device 3 defines the second threaded hole, and the screw passes through the first threaded hole and the second threaded hole to mount the connecting arm 31 on the mounting part 211 of the lifting device 2. In one embodiment, the socketing structure includes a bump part and a socketing hole. In detail, the mounting part 211 defines the bump part, and the connecting arm 31 of the mobility device 3 defines the socketing hole matching with the bump part, and the socketing hole grips the bump part to mount the connecting arm 31 on the mounting part 211 of the lifting device 2. In another embodiment, the snapfit structure includes a hook and a snapfit hole. In detail, the mounting part 211 defines the hook, and the connecting arm 31 of the mobility device 3 defines the snapfit hole, and the hook of the mounting part 211 is hooked by the bump part to mount the connecting arm 31 on the mounting part 211 of the lifting device 2.

Figure 7:
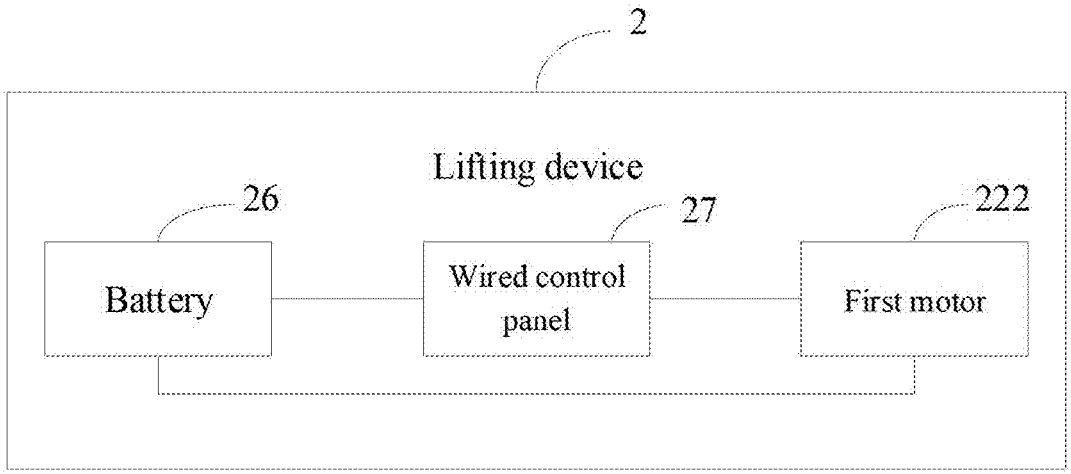
FIG. 7 is a schematic diagram of an exemplary embodiment of the lifting device.

FIG. 7 illustrates another exemplary embodiment of the lifting device 2. In one embodiment, the lifting device 2 further includes a battery 26 and a wired control panel 27. The battery 26 connects to the wired control panel 27 and the first motor 222, and supplies electric power for the wired control panel 27 and the first motor 222. The wired control panel 27 connects to the first motor 222. The wired control panel 27 controls the first motor 222 to drive the retractable rod 224 upward or downward to adjust height of the sitting pad 24. In one embodiment, the lifting device 2 communicates with a terminal device and is controlled by the terminal device. In one embodiment, the terminal device can be a smart phone, a panel, a wearable device, or a remote controller. In one embodiment, the lifting device 2 is also controlled by an onboard computer in the mobility device 3.

Figure 8:
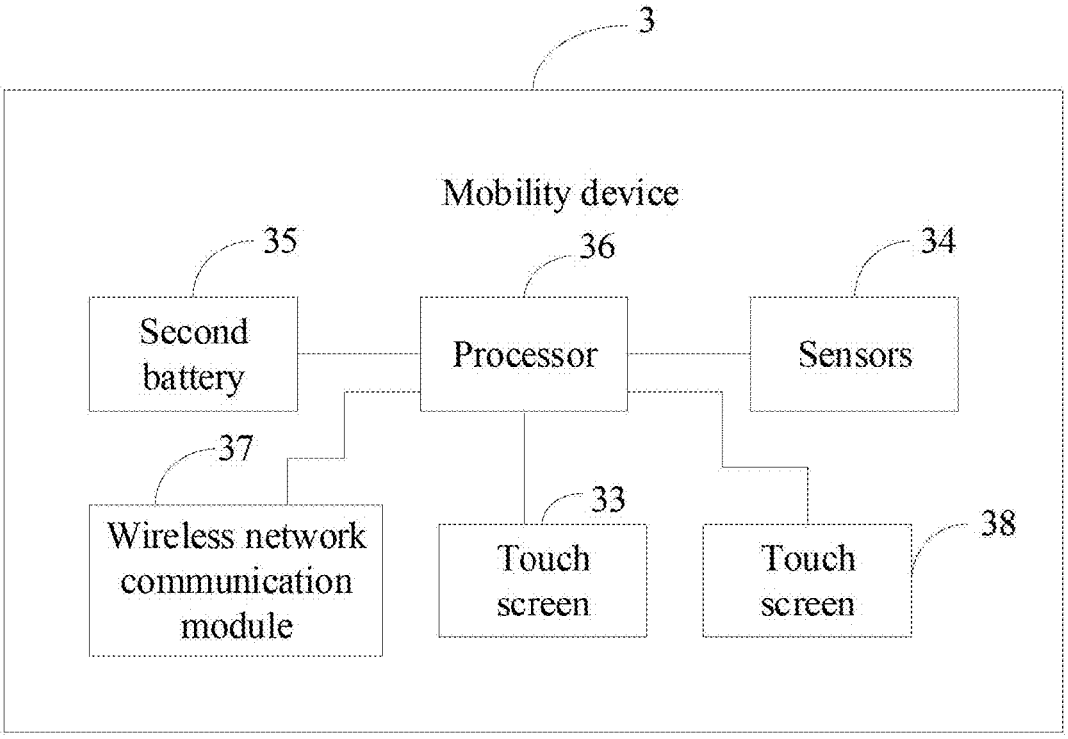
FIG. 8 is a schematic diagram of an exemplary embodiment of the device of FIG. 1.

FIG. 8 illustrates another exemplary embodiment of the mobility device 3. In one embodiment, the mobility device 3 includes sensors 34, a second battery 35, a processor 36, a wireless network communication module 37, and a touch screen 38. In one embodiment, the processor 36 connects to the sensors 34, the second battery 35, the wireless network communication module 37, and the touch screen 38. In one embodiment, the processor 32 can be a central processing unit (CPU), a microprocessor, or other data processor chip that performs functions of the mobility device 3. In one embodiment, the processor 36 can be an onboard computer. The sensors 34 include, but are not limited to, a lidar device, a camera, a radar device, an inertial measurement unit (IMU), and a GPS device. In one embodiment, an exact configuration of the sensors 34 can vary depending on an operation environment and cost. The mobility device 3 can obtain many kinds of data by the sensors 34, and perform a variety of service functions according to the data. In one embodiment, the mobility device 3 can obtain location and distance in relation to a target object, by the lidar. The mobility device 3 can obtain image data from the mobility device 3 by the camera. The mobility device 3 can obtain a mobility state (in motion or stationary state) of the mobility device 3 by the IMU. The mobility device 3 can obtain geographical location of the mobility device 3 by the GPS device. In one embodiment, the second battery 35 supplies electric power for the sensors 34, the processor 36, the wireless network communication module 37, and the touch screen 38. The mobility device 3 communicates with the lifting device 2 by the wireless network communication module 37, and controls the lifting device 2 accordingly. The touch screen 38 receives user input and displays information as to the mobility device 3.

In one embodiment, by leveraging the existing computational resources that enables self-driving and the data acquired by the sensors 34, the mobility device 3 can run machine learning software to track a behavior of the user, by leveraging the data obtained by the sensors 34 and the existing computational resources that enable self-driving behavior. A caregiver can be notified in case of malfunction or emergency. In one embodiment, the mobility device 3 allow the user to enjoy entertainment on the go and talk to friends and families. In one embodiment, the mobility device 3 also includes a robotic arm 39 (referring to FIG. 5(*a*)). The mobility device 3 can control the robotic arm 39 to help the user do daily activities such as picking up a book, opening a door, or serving food etc. In one embodiment, the mobility device 3 also includes a joystick 30 (referring to FIG. 5(*b*)), the joystick 30 enable the user to operate the mobility device 3 directly. For example, the user is able to do cart racing with friends by operating the joystick 30. In one embodiment, the mobility device 3 also includes a fully-enclosed compact toilet 300 (referring to FIG. 5(*c*)). A top cover of the fully-enclosed compact toilet 300 can open and close by itself on demand. When the top cover of the fully-enclosed compact toilet 300 closes, the opening 2412 of the sitting pad 24 fits the top cover of the fully-enclosed compact toilet 300, forming a flat surface. Thus, the mobility device 3 enables long journeys for the user without discomfort of wearing a diaper.

Figure 9:
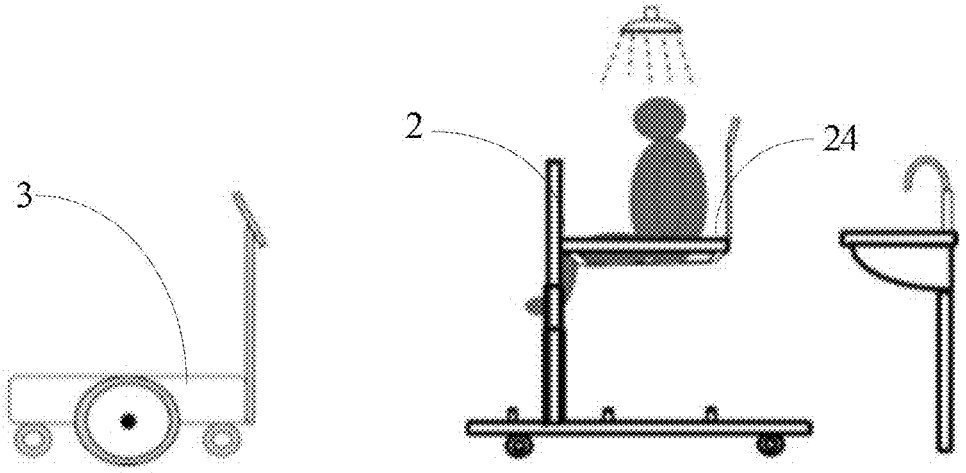
FIG. 9 is an isometric view showing an exemplary embodiment of bathroom use of the mobility device.

FIG. 9 illustrates an exemplary embodiment of the mobility device 3 in use in a bathroom. In one embodiment, by the lifting device 2, the intelligent mobility assistance device 1 can securely lift the user out of the bed 6 and move the user to the bathroom, rest the user on the sitting pad 24 of the lifting device 2, with little or no assistance, improving user's life quality and reducing the risk of injuries at the same time. Due to its relatively simple design, the lifting device 2 can safely operate in a shower. The mobility device 3 can move the user under the shower, then the mobility device 3 is detached from the lifting device 2 and moves back. After the user has done showering, the mobility device 3 is again mounted on the lifting device 2 and drives the lifting device 2 to move away from the bathroom.

Figure 10A:
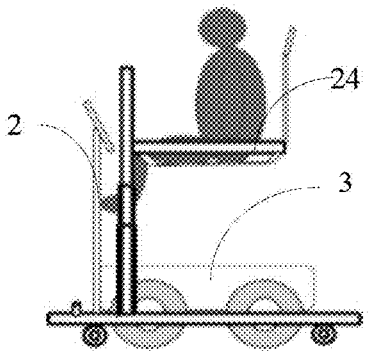
FIGS. 10(*a*) and 10(*b*) are isometric views showing another exemplary embodiment of the mobility device with the lifting device.
Figure 10B:
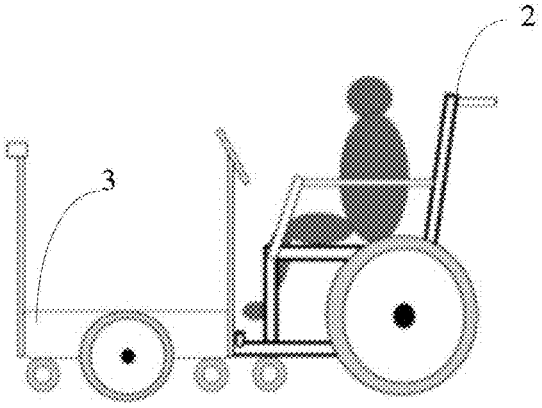

FIGS. 10(*a*) and 10(*b*) illustrate an exemplary embodiment of the mobility device 3 connecting to the lifting device 2. In one embodiment, referring to FIG. 10(*a*), the mobility device 3 can be fixed under the sitting pad 24 of the lifting device 2, thus an overall size of the intelligent mobility assistance device 1 is reduced, enabling the intelligent mobility assistance device 1 to move in a narrow space (e.g. an elevator or a bathroom). In another embodiment, referring to FIG. 10(*b*), the lifting device 2 connected with the mobility device 3 can be a wheelchair. The mobility device 3 can lift and carry the wheelchair to destinations, such as tourist sites or airports, much more conveniently.

Figure 11A:
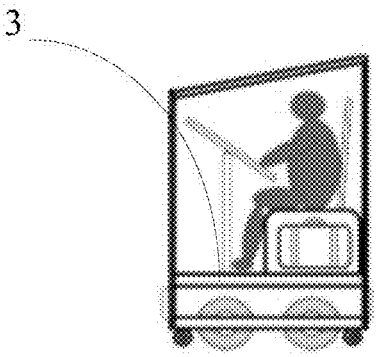
FIGS. 11(*a*), 11(*b*), and 11(*c*) are isometric views showing another exemplary embodiment of the mobility device.
Figure 11B:
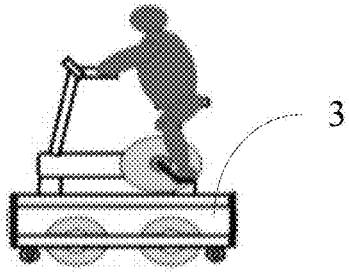
Figure 11C:
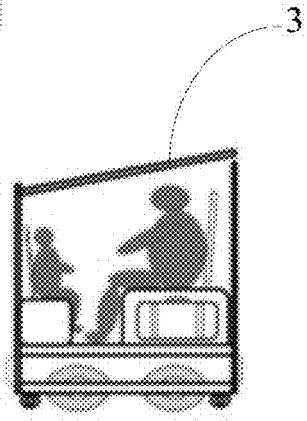

FIGS. 11(*a*)-11(*c*) illustrate another exemplary embodiment of the mobility device 3. In one embodiment, referring to FIG. 11(*a*), the mobility device 3 has a closed structure. For example, the mobility device 3 has the appearance of a telephone-booth in which a person can sit and work. In one embodiment, referring to FIG. 11(*b*), the mobility device 3 can function as an exercise bike. A commuter using the mobility device 3 can do physical training during the commute, in the meanwhile generating electricity to charge the mobility device 3. In one embodiment, referring to FIG. 11(*c*), the mobility device 3 has a lager closed structure to accommodate families or a group of people. The mobility device 3 with larger closed structure requires heavier or multiple driving device 33 to drive the mobility device 3 to move.

In one embodiment, a detachable self-driving mobility device 3 combined with a private (or semi-private) space may become a critical component of integrated personal transport solutions in the future. It has an unique advantages compared to the abilities of current self-driving cars.

In the embodiment, the intelligent mobility assistance device 1 can be used as a low-speed and small-volume mobility solution, which not only serves a disabled person, but also solves daily short-distance travel needs for ordinary people, further reducing energy consumption, at least compared to cars. In one embodiment, the intelligent mobility assistance device 1 can also be automatically loaded and fixed to a specially designed larger vehicle to achieve high speed and long distance commuting, which allows passengers not to leave their seats and carry their luggage in multiple transfer environment, and retains the autonomy and privacy of each passenger.

The exemplary embodiments shown and described above are only examples. Even though numerous characteristics and advantages of the present disclosure have been set forth in the foregoing description, together with details of the structure and function of the present disclosure, the disclosure is illustrative only, and changes may be made in the detail, including in matters of shape, size and arrangement of the parts within the principles of the present disclosure, up to and including the full extent established by the broad general meaning of the terms used in the claims.

What is claimed is:

1. An intelligent mobility assistance device, the intelligent mobility assistance device comprising:

a mobility device;

a lifting device detachably mounted on the mobility device;

wherein, the lifting device comprises a base frame, a retractable bracket structure, a plurality of wheels, a sitting pad, and a backrest, the plurality of wheels are mounted on a lower surface of the base frame, and are driven by the mobility device, the retractable bracket structure is mounted on an upper surface of the base frame, the sitting pad is detachably mounted on the retractable bracket structure, the backrest is rotatably mounted on the retractable bracket structure, wherein the retractable bracket structure comprises support frames, each of the support frames comprises a vertical column, a retractable rod, a first motor, and a mounting part, the retractable rod connects to the vertical column and drives the retractable rod to stretch out from the vertical column or retract into the vertical column, the mounting part is fixed on the retractable rod, wherein the mounting part comprises a safety rail and an arm part, the sitting pad is detachably mounted on the arm part of the mounting part, the safety rail is mounted on the retractable rod of the support frames, and the support frames can move upward or downward under the driving of the retractable rod, the backrest comprises two ends, one of the two ends of the backrest is rotatably mounted on the safety rail of one of the support frames by a rotating shaft, another one of the two ends of the backrest connects to the safety rail of the other of the support frames by a locking structure, and the first motor is received in the base frame.

2. The intelligent mobility assistance device of claim 1, wherein the base frame comprises a pair of strips.

3. The intelligent mobility assistance device of claim 2, wherein the retractable bracket structure comprises two support frames and a horizontal rod, each of the two support frames is mounted on one of the pair of strips, the two support frames connect to each other by the horizontal rod.

4. The intelligent mobility assistance device of claim 3, wherein the horizontal rod connects to two vertical columns of the two support frames.

5. The intelligent mobility assistance device of claim 2, wherein the sitting pad is mounted on the two arm parts of the two support frames.

6. The intelligent mobility assistance device of claim 5, wherein the sitting pad comprises a connection part, and the sitting pad connects to the arm part of the support frame by the connection part.

7. The intelligent mobility assistance device of claim 6, wherein the connection part comprises a buckle, the buckle connects to the sitting pad.

8. The intelligent mobility assistance device of claim 6, wherein the sitting pad further comprises two safety belts, the two safety belts are mounted on one side of the sitting pad.

9. The intelligent mobility assistance device of claim 8, wherein the two safety belts connect to the arm part of the support frame or separate from the arm part.

10. The intelligent mobility assistance device of claim 6, wherein the arm part comprises an extra vertical column, the extra vertical column extends from the arm part in a vertical upward direction, the sitting pad is mounted on the arm part by the connection part, and the sitting pad connects to a top end of the extra vertical column by a stretching part.

11. The intelligent mobility assistance device of claim 2, wherein the mobility device comprises a plurality of the connecting arms, a pair of second wheels, and a driving device, the driving device drives the pair of second wheels to move the mobility device flexibly.

12. The intelligent mobility assistance device of claim 11, wherein the pair of strips defines a plurality of mounting parts, the plurality of connecting arms of the mobility device connect to the plurality of mounting parts to make the lifting device connect to the mobility device.

13. The intelligent mobility assistance device of claim 12, wherein the socketing structure comprises a bump part and a socketing hole, each of the plurality of the mounting parts defines the bump part, and the connecting arm defines the socketing hole matched with the bump part, and the socketing hole grips the bump part to mount the connecting arm on each of the plurality of the mounting parts of the lifting device.

14. The intelligent mobility assistance device of claim 2, wherein each of the strips is made of metal or alloy material.

* * * * *